US005557168A

United States Patent [19]

Nakajima et al.

[11] Patent Number: 5,557,168

[45] Date of Patent: Sep. 17, 1996

[54] GAS-DISCHARGING TYPE DISPLAY DEVICE AND A METHOD OF MANUFACTURING

[75] Inventors: Fumio Nakajima, Kumagaya; Satoshi Watanabe, Ohsato-gun, both of Japan

[73] Assignee: Okaya Electric Industries Co., Ltd., Tokyo, Japan

[21] Appl. No.: 219,781

[22] Filed: Mar. 30, 1994

[30] Foreign Application Priority Data

| | | | |
|---|---|---|---|
| Apr. 2, 1993 | [JP] | Japan | 5-100569 |
| Apr. 2, 1993 | [JP] | Japan | 5-100570 |
| Feb. 16, 1994 | [JP] | Japan | 6-041895 |
| Feb. 17, 1994 | [JP] | Japan | 6-043054 |
| Feb. 21, 1994 | [JP] | Japan | 6-046335 |

[51] Int. Cl.[6] ..... H01J 17/49; H01J 17/20

[52] U.S. Cl. ..... 313/586; 313/484; 313/643; 313/346 R; 315/169.4

[58] Field of Search ..... 313/484, 486, 313/487, 582, 586, 587, 643, 346 R; 315/169.4; 428/690

[56] References Cited

U.S. PATENT DOCUMENTS

| | | | |
|---|---|---|---|
| 3,497,751 | 2/1970 | Cullis, Jr. | 313/484 |
| 3,716,742 | 2/1973 | Nakayama et al. | 313/587 |
| 3,766,420 | 10/1973 | Ogle et al. | 313/484 |
| 3,886,390 | 5/1975 | Maloney et al. | 313/484 |
| 4,039,889 | 8/1977 | Vicai | 313/487 |
| 4,393,326 | 7/1983 | Kamegaya et al. | 313/582 |
| 4,554,482 | 11/1985 | Kamegaya et al. | 313/582 |
| 4,692,662 | 9/1987 | Wada et al. | 313/587 |
| 4,814,758 | 3/1989 | Park | 313/582 |
| 4,827,186 | 5/1989 | Knauer et al. | 313/487 |
| 5,032,768 | 7/1991 | Lee et al. | 313/582 |
| 5,164,633 | 11/1992 | Kim et al. | 313/586 |
| 5,371,437 | 12/1994 | Amano | 313/586 |

*Primary Examiner*—Sandra L. O'Shea
*Assistant Examiner*—Matthew J. Esserman
*Attorney, Agent, or Firm*—Thomas R. Morrison; Christopher R. Pastel

[57] ABSTRACT

A panel-shaped gas-discharging type display device includes an anode and a cathode having a special shape to enhance discharging in an airtight chamber formed by two substrates. A gas containing an ultraviolet emission gas such as Xe and Kr and a fluophor for emitting a light are put together into the airtight chamber. Because of the shape of the cathode, more discharging occurs than with conventional devices. More ultraviolet emission from the discharging excites the fluophor to create a visible radiation. Therefore, the brightness of the device increases. Since the cathode is coated with an emitter material incapable of absorbing the ultraviolet emission gas, discharging is not obstructed by reduction of the ultraviolet emission gas, and the color of the visible radiation is stably maintained.

34 Claims, 16 Drawing Sheets

GAS-DISCHARGING TYPE DISPLAY DEVICE AND A METHOD OF MANUFACTURING

BACKGROUND OF THE INVENTION

1. Field of the Invention

This invention relates to a gas-discharging type display device, and more particularly, to the gas-discharging type display device which has both an anode and a cathode facing each other in an airtight chamber filled with a gas, and a production method for such a device.

2. Description of the Prior Art

In the conventional technique, a panel-shaped gas-discharging type display device 90, shown in FIG. 20, is composed of a rear insulating substrate 92 with a plurality of belt-shaped cathodes 91 and a front transparent insulating substrate 94 with a plurality of belt-shaped transparent anodes 93. Both rear insulating substrate 92 and front insulating transparent substrate 94 are arranged such that each belt-shaped cathode 91 faces a corresponding anode 93 a predetermined distance apart and are crossed to each other. Both rear insulating substrate 92 and front insulating transparent substrate 94 form an airtight chamber 95 by processing the sides, which is filled with a gas including Xe (xenon) for ultraviolet emission.

A plurality of front barrier ribs 96 are formed on the surface of rear insulating substrate 92 and front insulating transparent substrate 94 in airtight chamber 95. A plurality of discharge cells 97 are disposed in a rectangular array at the junction of each belt-shaped cathode 91 and belt-shaped transparent anode 93. A spacer 98 is located between rear insulating substrate 92 and front barrier rib 96. A space 99 is formed next to spacer 98 so as to connect discharge cells 97. A fluophor 100 is applied to the inner wall of rear insulating substrate 92 and along front barrier rib 96.

Belt-shaped cathode 91 is produced by applying an emitter material, containing $LaB_6$ as a main ingredient, to a cathode base of Ag·Pd (silver·palladium) paste and the like by plasma spray coating. The emitter material lowers a threshold voltage for discharging, and further increases the anti-spatter property.

A direct-current voltage is selectively biased between belt-shaped transparent anode 93 and belt-shaped cathode 91. Discharging is controlled to occur at desired discharge cell 97. Ultraviolet emission generated by the discharging excites fluophor 100, resulting in a light emission through belt-shaped transparent anode 93 and front insulating transparent substrate 94, which color corresponds to fluophor 100. Thereby a desired character and figure can be seen outside. In discharging, ions are transferred between discharge cells 97 through space 99.

Referring to FIG. 20, the prior art panel-type gas discharge display device includes a negative electrode shaped as a flat band, or belt-shaped. Therefore, during operation, the discharge tended to occur only within the relatively small confines of the discharge cell. This limitation made it difficult to achieve an adequate brightness.

A problem with the conventional device, however, is that its brightness rapidly decreases and the color becomes unstable for a long period of time. Furthermore, since the device is relatively thin, discharging occurs only in a limited space, thereby making its brightness unsatisfactory for a display device.

OBJECTS AND SUMMARY OF THE INVENTION

Accordingly, it is an object of the present invention to provide a gas-discharging type display device with high stability so as to prevent unexpected reduction of the brightness or unstability of the color in long-time use.

It is a further object of the invention to provide a panel-shaped gas-discharging type display device with a plurality of discharge cells, each of which has a high efficiency for light emission so as to bring high brightness.

According to a preferred embodiment, there is provided a gas-discharging type display device comprising: an airtight chamber, at least one cathode in the airtight chamber, at least one anode in the airtight chamber, the cathode having an emitter material on the surface, the cathode and the anode facing each other a predetermined distance apart, a discharge gas in the airtight chamber, a fluophor in the airtight chamber, the discharge gas containing at least Xe, and the emitter material containing at least $GdB_6$.

Briefly stated, the present invention provides a panel-shaped gas-discharging type display device consisting of an anode and a cathode which has a special shape to enhance discharging in an airtight chamber formed by two substrates. A gas containing an ultraviolet emission gas such as Xe and Kr and a fluophor for emitting a light are put together in the airtight chamber. Because of the shape of the cathode, more discharging occurs than that of the conventional devices. More ultraviolet emission by the discharging excites the fluophor to create a visible radiation. Thereby, the brightness increases. Since the cathode is coated by an emitter material incapable of absorbing the ultraviolet emission gas, discharging is not obstructed by reduction of the ultraviolet emission gas, the color of the visible radiation can be stably maintained.

According to an embodiment of the invention, there is provided a gas-discharging type display device comprising: a front substrate, the at least one anode on the front substrate, which is. belt-shaped and transparent, the front substrate formed of a transparent insulating material, a rear substrate, at least one cathode on the rear substrate, which includes a belt-shaped lead, the rear substrate formed of an insulating material, the at least one anode and the at least one cathode crossing each other a predetermined distance apart, making at least one discharge cell at the junction, the front substrate and the rear substrate forming an airtight chamber, the airtight chamber filled with a discharge gas, a cathode lead pattern on the inner surface of the rear substrate, a cathode support layer covering the cathode lead pattern, and the at least one cathode having a cylindrical shape, whose one end is connected to the cathode lead pattern in the cathode support layer and whose other end protrudes outside of the cathode support layer.

The result of the experiment and analysis by XMA (X-ray micro analyzer) shows that a main ingredient, $LAB_6$, of the emitter material absorbs Xe in a gas. Then Xe gradually decreases and less ultraviolet emission occurs, thereby reducing the light emission and lowering the brightness. For varying the color, it seems that a ratio of the ingredients such as Xe and other components like Ar (argon) and Ne (neon) are changed because of reduction of Xe, so that the color is affected by other components. To solve the problem, it is necessary to use an emitter material incapable of absorbing Xe. Further, an ultraviolet emission gas capable of existing with $LaB_6$ is required.

A gas-discharging type display device of the invention is composed of an anode, a cathode on which an emitter material is disposed, a gas containing the ultraviolet emission gas and a fluophor. The anode and cathode within the ultraviolet emission gas and fluophor are arranged airtight as facing each other a proper distance apart for discharging. Xe is preferably used for the ultraviolet emission gas. The emitter material contains $GdB_6$ or MoB. Since $GdB_6$ and MoB are incapable of absorbing Xe, the above problem with respect to the brightness and the color is solved automatically. Kr can be used for the ultraviolet emission gas. It is also acceptable to use $LaB_6$ as the emitter material.

To achieve the further object, a panel-shaped gas-discharging type display device is composed of a front substrate of a transparent insulating material with a plurality of transparent anodes and a rear substrate of an insulating material with a plurality of cathodes. Both substrates form an airtight chamber filled with a gas, and are arranged such that the anode and cathode face each other a predetermined distance apart to produce discharge cells in a rectangular array in the airtight chamber. A cathode lead pattern is attached to the surface of the rear substrate. The cathode lead pattern is covered with a cathode support layer. A cylindrical cathode is disposed on and connected to the cathode lead pattern. One end of the cylindrical cathode is buried in the cathode support layer, and the other end protrudes outside of the cathode support layer. Since the cathode has a cylindrical shape and the other end of the cathode protrudes outside, the cathode support layer a wider area of the cathode can be involved in discharging. Therefore, the light emission and the brightness of the display significantly increase.

The above, and other objects, features and advantages of the present invention will become apparent from the following description read in conjunction with the accompanying drawings.

DETAILED DESCRIPTION OF THE PREFERRED EMBODIMENTS

Figure 1:
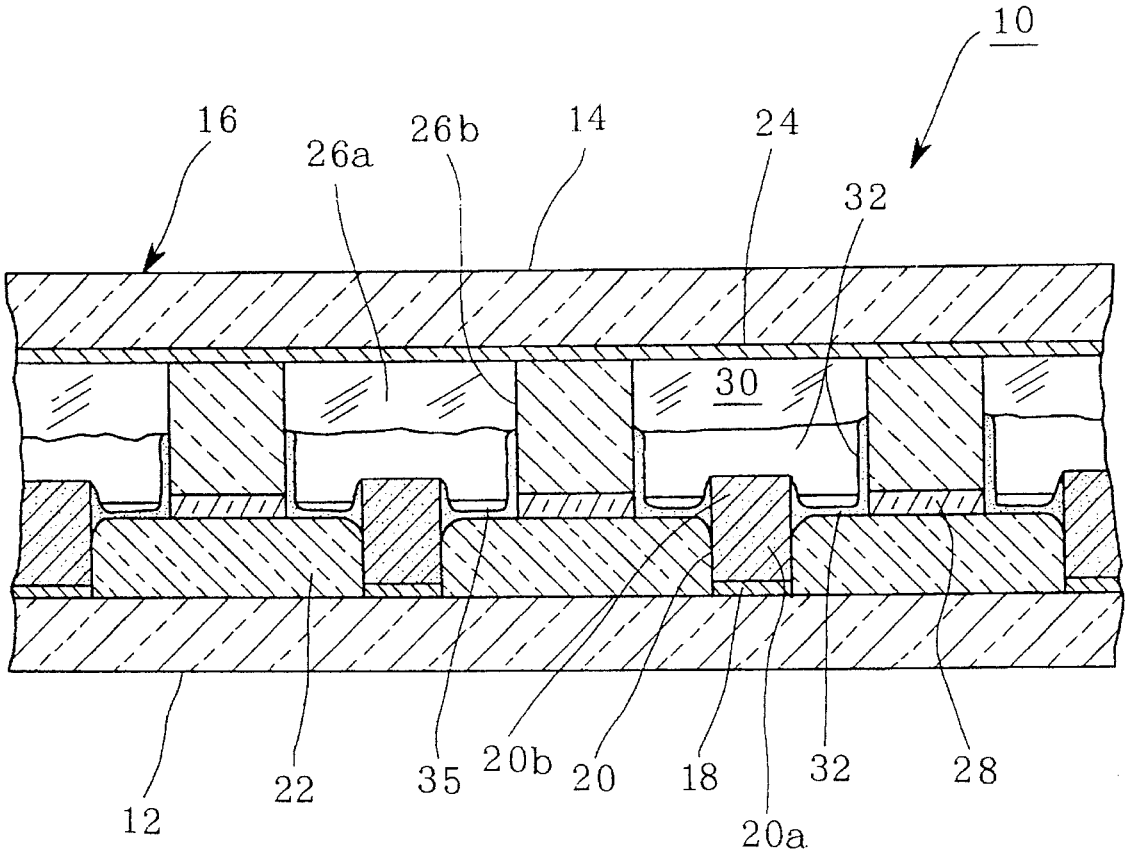
FIG. 1 is a cross-section of a first gas-discharging type display device of the invention.

Referring to FIG. 1, a first gas-discharging type display device 10 having a panel shape includes of a rear substrate 12 of an insulating material like a flat-shaped glass and a front substrate 14 of a transparent insulating material like a flat-shaped transparent glass. Rear substrate 12 and front substrate 14, facing each other a predetermined distance apart, are arranged airtight to form an airtight chamber 16 by processing the side with an adhesive material like a low melting-point glass. A gas composed of Xe, He, Ar and Ne is inserted into airtight chamber 16 for discharging. A ratio of the ingredients of the gas is predetermined.

Figure 2:
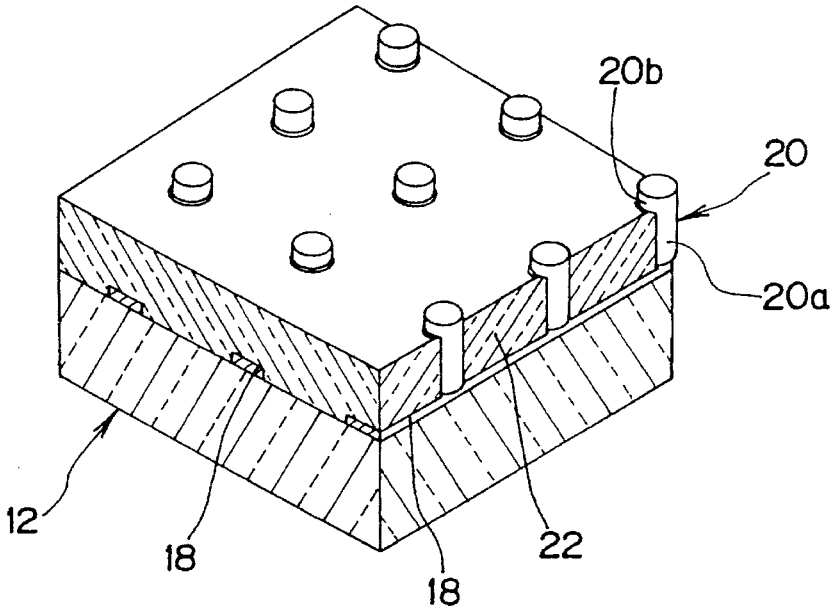
FIG. 2 is a partial perspective view for showing a rear substrate of FIG. 1.

Referring now to FIG. 2, rear substrate 12 includes a plurality of belt-shaped cathode leads forming a cathode lead pattern 18 of a Ag·Pd-type paste and a plurality of first cylindrical cathodes 20 connected to cathode lead pattern 18. Each of first cylindrical cathodes 20 is formed of an emitter material containing $GdB_6$ and $BaAl_2O_4$ in a ratio of approximately 2:1. A cathode support layer 22 of an insulating material like a glass is located on the surface of rear substrate 12 and cathode lead pattern 18. One end 20*a* of first cylindrical cathode 20 is buried in cathode support layer 22, and the other end 20*b* protrudes outside of cathode support layer 22.

Figure 3:
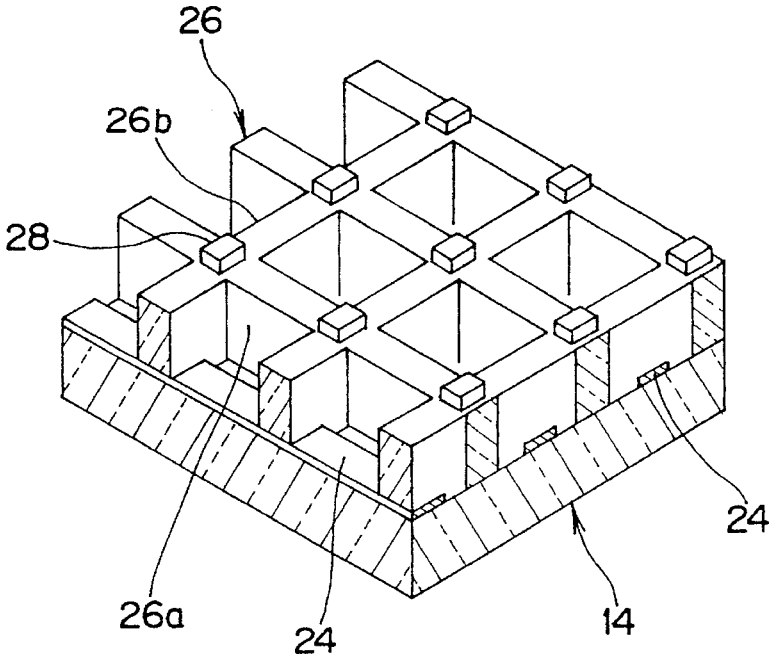
FIG. 3 is a partial perspective view for showing a front substrate of FIG. 1.

Referring to FIG. 3, a plurality of belt-shaped transparent anodes 24 made of NESA film ($SnO_2$) or ITO film ($In_2O_3 \cdot SnO_2$) are attached to the inner surface of front substrate 14. A front barrier rib 26 of an insulating material like a glass is formed on belt-shaped transparent anodes 24. Front barrier rib 26 has a plurality of first and second separating walls 26*a* and 26*b*. First separating walls 26*a* are arranged in parallel to, and a predetermined space apart from, belt-shaped transparent anodes 24. Second separating walls 26*b* are disposed in a perpendicular direction to first separating walls 26*b*, so that both first and second separating walls create a plurality of discharge cells 30 in a rectangular array. A spacer 28 of an insulating material like a glass is attached to the crossing of first and second separating walls 26*a* and 26*b*.

Returning to FIG. 1, cathode lead pattern 18 of rear substrate 12 and transparent anode 24 of front substrate 14 cross each other a predetermined distance apart, and each of first cylindrical cathodes 20 is located in corresponding discharge cell 30. Spacer 28 attached to front barrier rib 26 is in contact with the surface of cathode support layer 22. End 20*b* of first cylindrical cathode 20 faces belt-shaped transparent anode 24 a predetermined distance apart. A fluophor 32 which corresponds to a desired color is applied to a side portion of end 20*b* of first cylindrical cathode 20. Fluophor 32 is also applied to the surface of cathode support layer 22, the side of spacer 28, the bottom sides of first separating wall 26*a* and second separating wall 26*b* of front barrier rib 26.

A direct-current voltage from a power supply (not shown) is selectively biased between belt-shaped transparent anode 24 and first cylindrical cathode 20. Discharging occurs by the bias in selected discharge cells 30, and generates an ultraviolet emission which excites fluophor 32 to create a light emission, so that a desired character and figure can be seen outside belt-shaped transparent anode 24 and front substrate 14. The voltage bias is controlled by a control and drive circuit (not shown).

In the discharging, involvement of the side of first cylindrical cathode as well as the top improves the light emission and increases the brightness for clearly producing a character or figure on the display.

Figure 4:
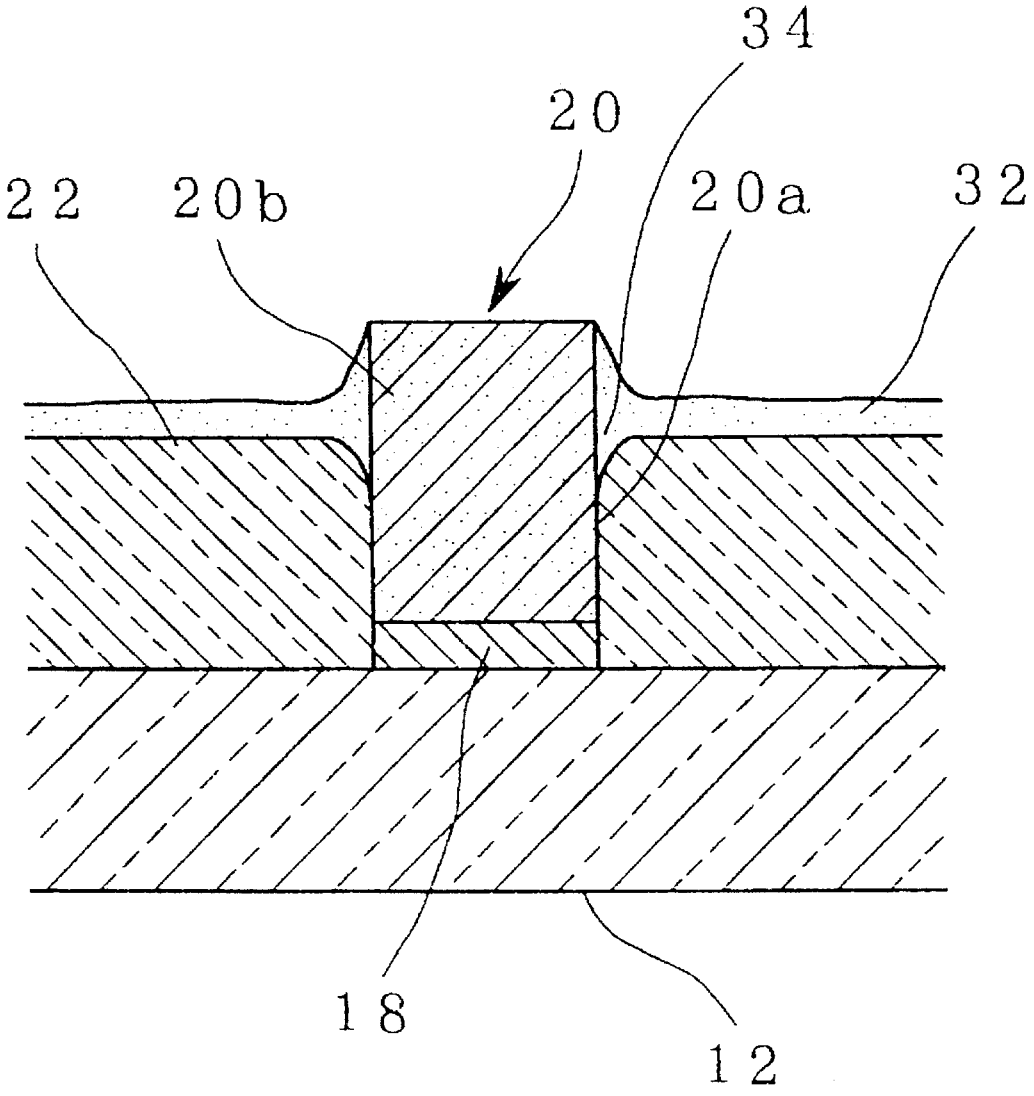
FIG. 4 is an enlarged partial cross-section for showing a first cylindrical cathode of FIG. 1.
Figure 5:
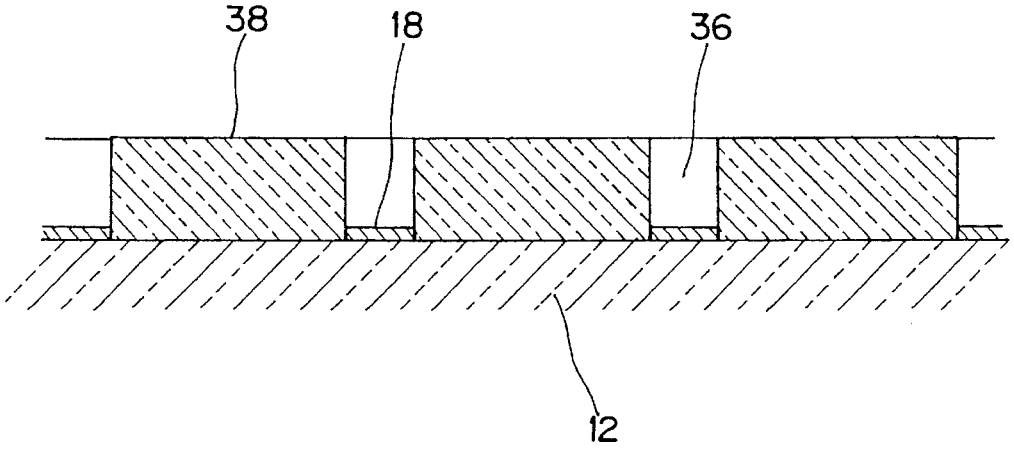
FIGS. 5 to 8 are cross-sections to show the method for producing a cathode support layer and a first cylindrical cathode of the first gas-discharging type display device of FIG. 1.
Figure 6:
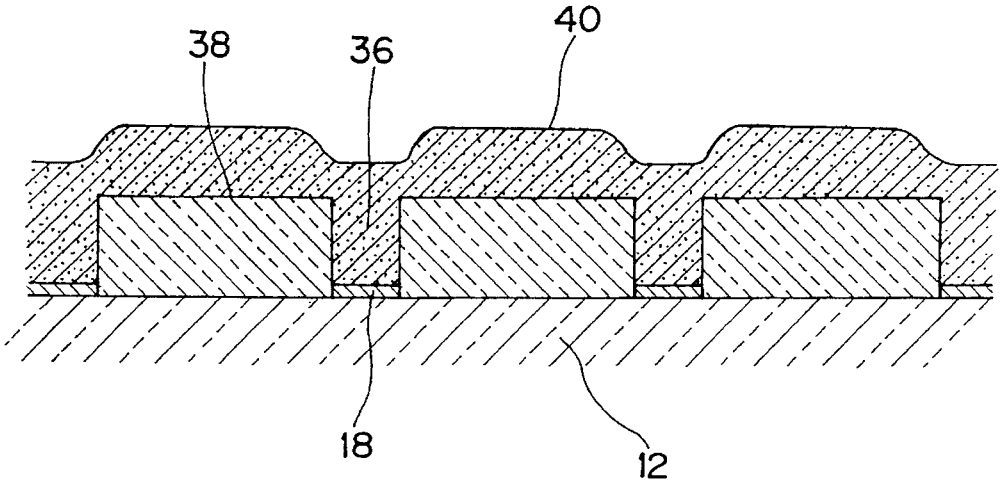
Figure 7:
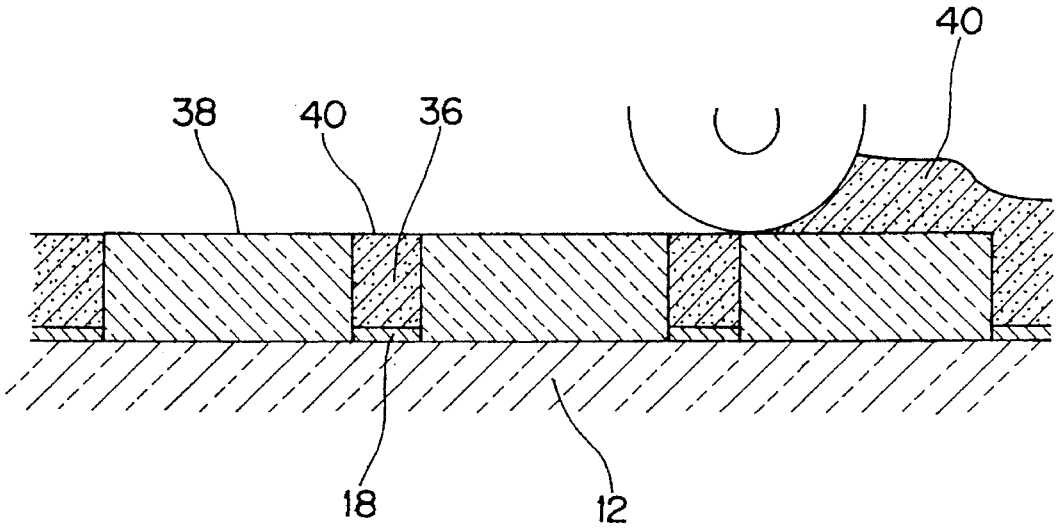
Figure 8:
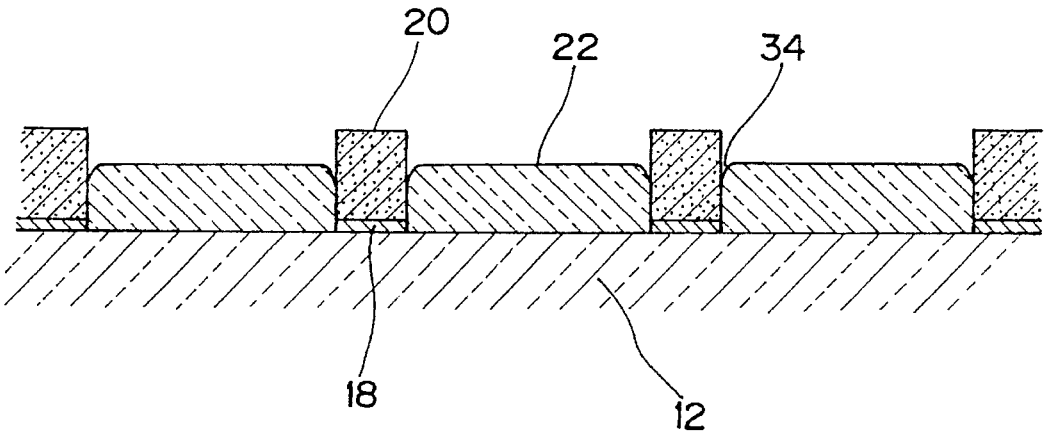

Referring to FIG. 4, first cylindrical cathode 20 is tightly supported by cathode support layer 22, thereby achieving a high connection strength in comparison with the case of connecting first cylindrical cathode 20 to only cathode lead pattern 18. Thus, even if first cylindrical cathode 20 becomes thin, the required connection strength can be secured. There are recesses 34 formed by first cylindrical cathode 20 and cathode support layer 22. Fluophor 32 applied on cathode support layer 22 becomes thick at recesses 34. Recesses 34 control the flow of melted fluophor 32 when fluophor 32 is applied on first cylindrical cathode 20.

As described above, since spacer 28 is between front barrier rib 26 and cathode support layer 22, a space 35 having the same height as spacer 28 is formed between first cylindrical cathode 20 and spacer 28. In discharging, ions can move between discharge cells 30 through space 35. Since space 35 is located much lower than end 20*b* of first cylindrical cathode 20, and the spatter material is mostly scattered toward front substrate 14, the spatter material rarely moves out to another discharge cell 30 through space 35. Thereby, it is possible to maintain the insulation property of airtight chamber 16.

The color of the light emission depends upon fluophor 32 and the ingredients, except Xe, of the gas. A desired color can be achieved by adjusting the above condition. It is also possible to produce a desired color by a color filter attached to the inner or outer surface of front substrate 14.

Referring to FIGS. 5 to 8, there is described the method for producing cathode support layer 22 and first cylindrical cathode 20. An Ag. Pd-type paste is printed on the inner surface of rear substrate 12 to create cathode lead pattern 18. At the same time, an insulating material such as a glass paste or a ceramic paste is applied in a proper thickness. A plurality of bases 38 and holes 36 are initially formed on cathode support layer 22. An emitter material 40 of $GdB_6$ and $BaAl_2O_4$ is applied to holes 36 by plasma spray coating. As a result, each of holes 36 is filled with emitter material 40. While $BaAl_2O_4$ is an insulating material originally, the plasma spray coating process removes Ba and increases electrical conductivity.

Unnecessary emitter material 40 on base 38 is ground and removed. Base 38 with emitter material 40 remaining in holes 36 is heat treated, thereby shrinking base 38 onto cathode support layer 22. To shrink base 38 of cathode support layer 22 entirely, the temperature during the heat treatment is set higher than that of the prior art. Since emitter material 40 in hole 36 is unshrinkable, it protrudes from cathode support layer 22 relative to base 38. This produces first cylindrical cathode 20. Recess 34 between cathode support layer 22 and first cylindrical cathode 20 is also formed by way of the heat treatment. The shrinking rate of base 38 depends upon the kind of material, the melting point of the material, and the temperature in the heat treatment. Obviously, it is possible to adjust the dimension of first cylindrical cathode 20 by varying the above conditions.

This production method is not limited to the above embodiment. It is acceptable to fill hole 36 with emitter material 40 by a printing process.

It is possible to produce first cylindrical cathode 20 such that an electrical conductive material like a Ni (nickel) paste is put into hole 36 and then emitter material 40 is applied at the top of first cylindrical cathode 20.

It is also acceptable originally to produce first cylindrical cathode 20 higher than cathode support layer 22 so as to form a protrusion.

A second gas-discharging type display device 50 has almost the same structure as first gas-discharging type display device 10. Differences between first and second gas-discharging type display devices 10 and 50 are shown.

Figure 9:
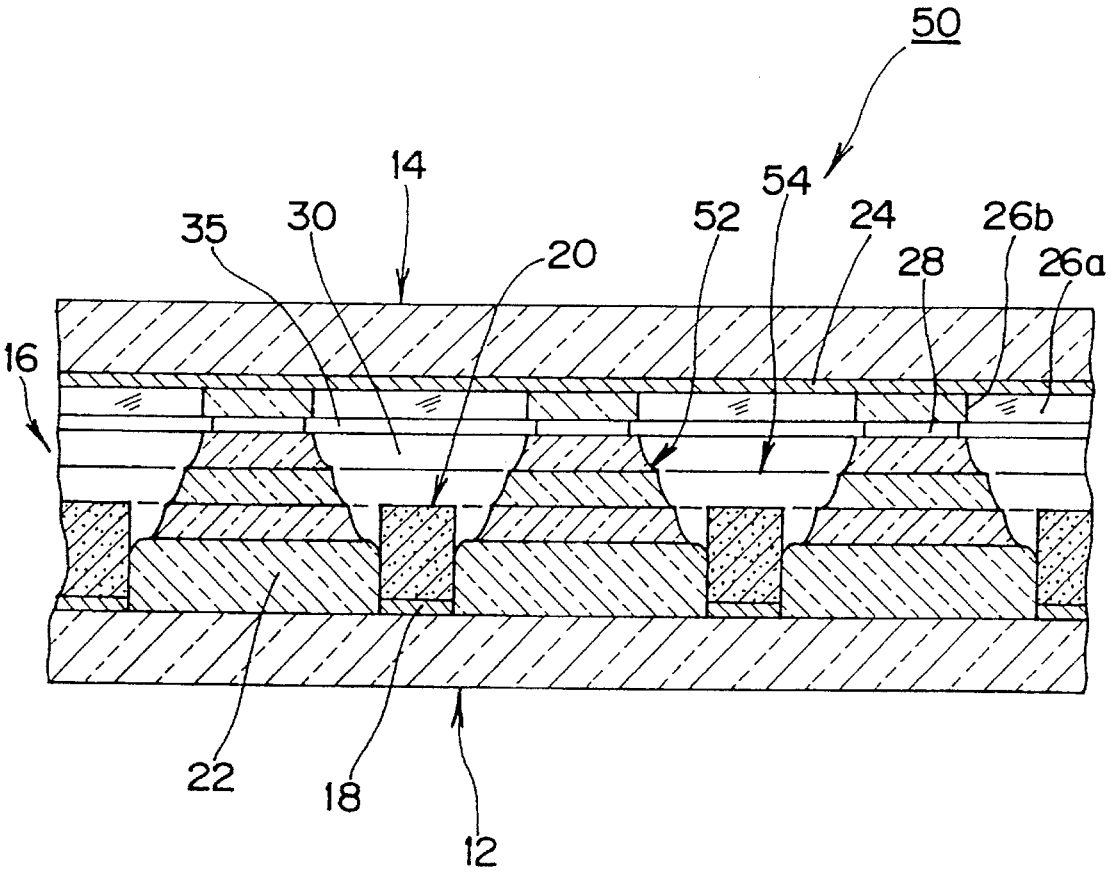
FIG. 9 is a cross-section of a second gas-discharging type display device of the invention.
Figure 10:
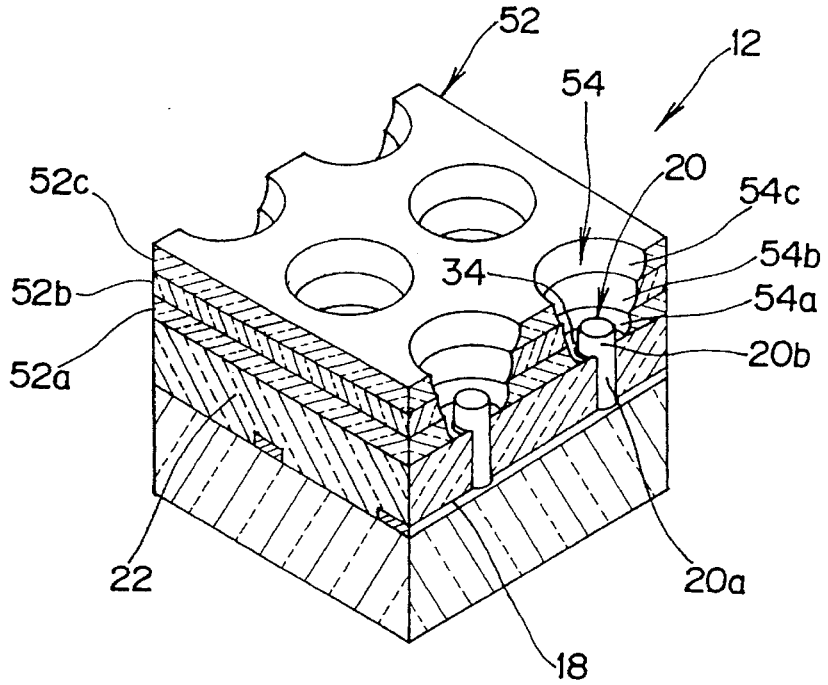
FIG. 10 is a partial perspective view for showing a rear substrate of FIG. 9.

Referring now to FIGS. 9 and 10, second gas-discharging type display device 50 includes a rear barrier rib 52 on the surface of cathode support layer 22. Rear barrier rib 52, formed by an insulating material like a glass, has a three layer structure: a first layer 52*a* in contact with the surface of cathode support layer 22, a second layer 52*b*, and a third layer 52*c*. Each layer contains a plurality opening 54. Each of openings 54 of one layer corresponds to that of the other layers. The center axes of corresponding openings 54 are the same in the three layers. When the three layers are disposed properly, each of the concentric openings has a diameter which is progressively larger than the concentric opening below it. First cylindrical cathode 20 is located at the center of opening 54.

Figure 11:
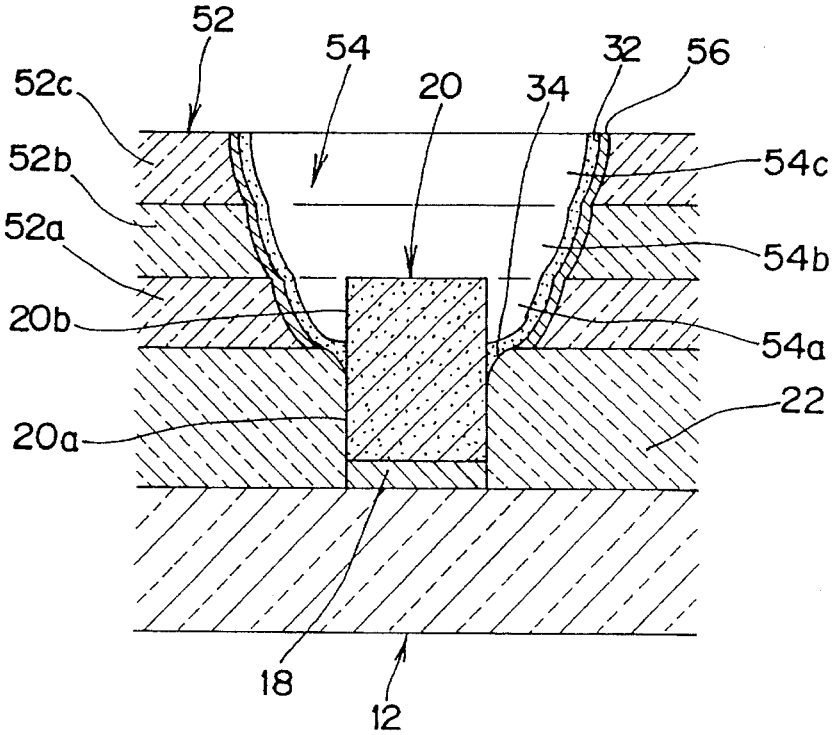
FIG. 11 is an enlarged partial cross-section for showing a first cylindrical cathode of FIG. 9.

Referring to FIG. 11, to form light reflecting layer 56, a metal such as Al (aluminum) or Ni is vacuum-evaporated to the inner surface of opening 54. Fluophor 32 is sprayed to cover the surfaces of light reflecting layer 56 and cathode support layer 22.

Figure 12:
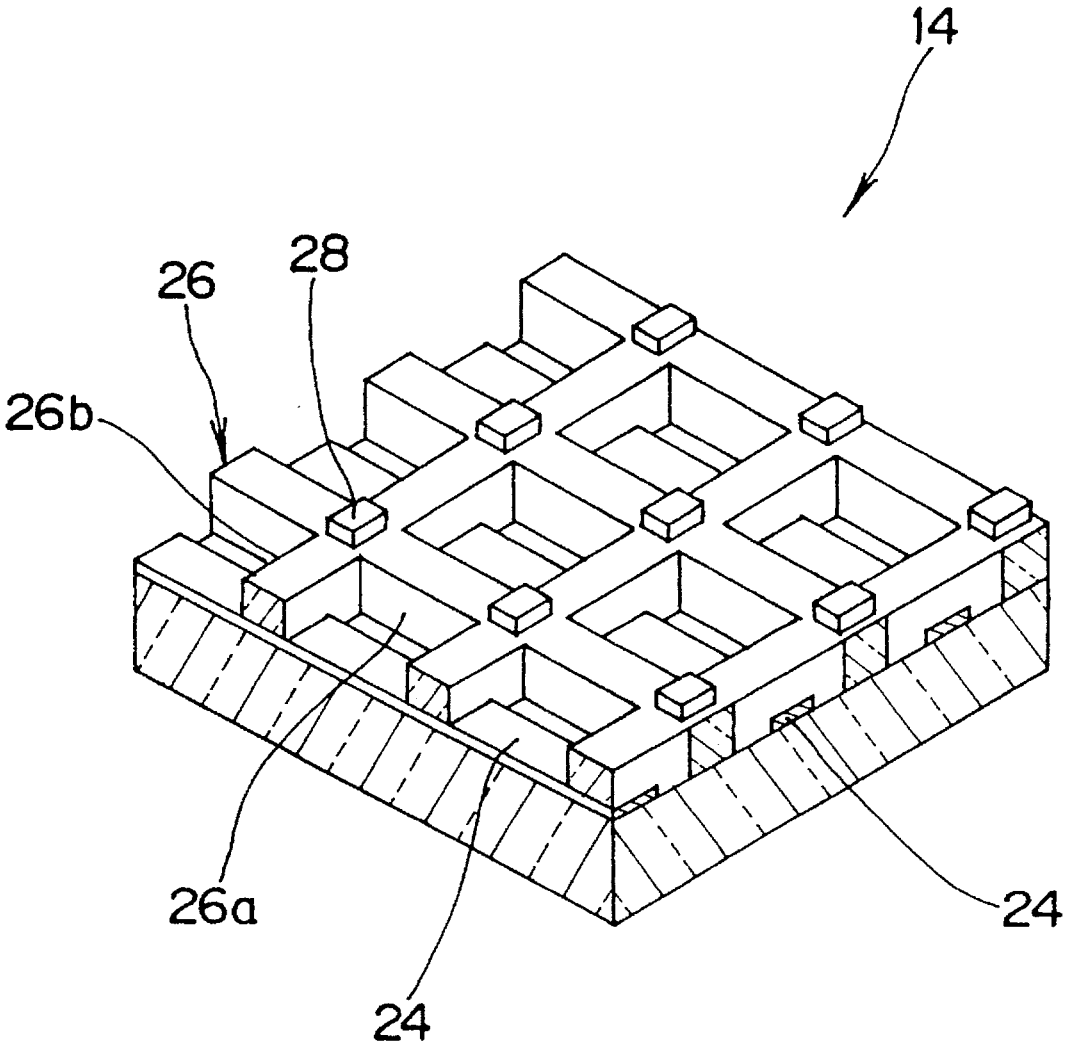
FIG. 12 is a partial perspective view for showing a front substrate of FIG. 9.

Referring to FIG. 12, front substrate 14 is almost the same as that of first gas-discharging type display device 10 except front barrier rib 26 is lower than that of the first device 10 in order to cover discharge cell 30. Spacer 28, attached on front barrier rib 26, can be in contact with the surface of rear barrier rib 52. Space 35, having the same height as that of spacer 28, is formed in the same way as on first gas-discharging type display device 10. During discharging, ions can move between discharge cells 30 through space 35.

Since second gas-discharging type display device 50 has the above-described openings 54 of rear barrier rib 52, a light emission generated by discharging is reflected by light reflecting layer 56 and effectively gathered at front substrate 14.

Rear barrier rib 52 is produced in a heat treatment after an insulating material such as a glass paste or a ceramic paste is printed relatively thick. It is also possible to produce rear barrier rib 52 by accumulating a plurality of thin glasses. Light reflecting layer 56 can be removed in the invention. Instead, rear barrier rib 52 itself can be formed by a light reflecting material, and also made as a single layer structure.

Figure 13:
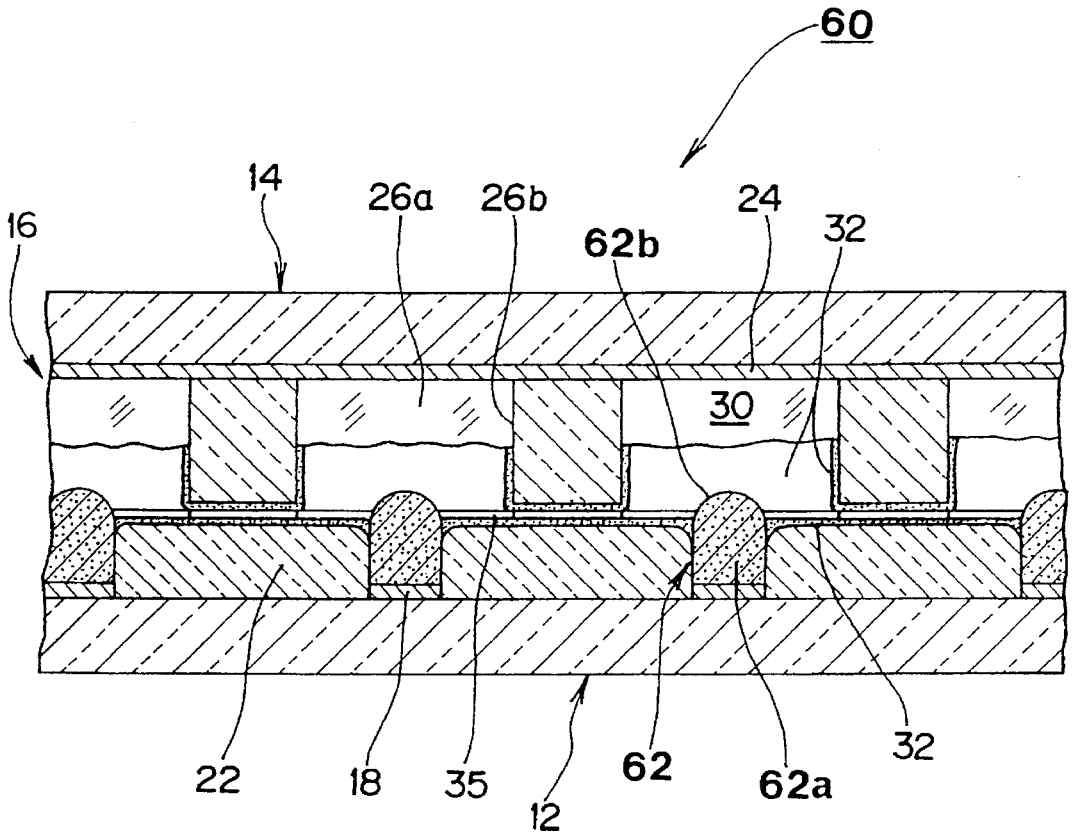
FIG. 13 is a cross-section of a third gas-discharging type display device of the invention.
Figure 14:
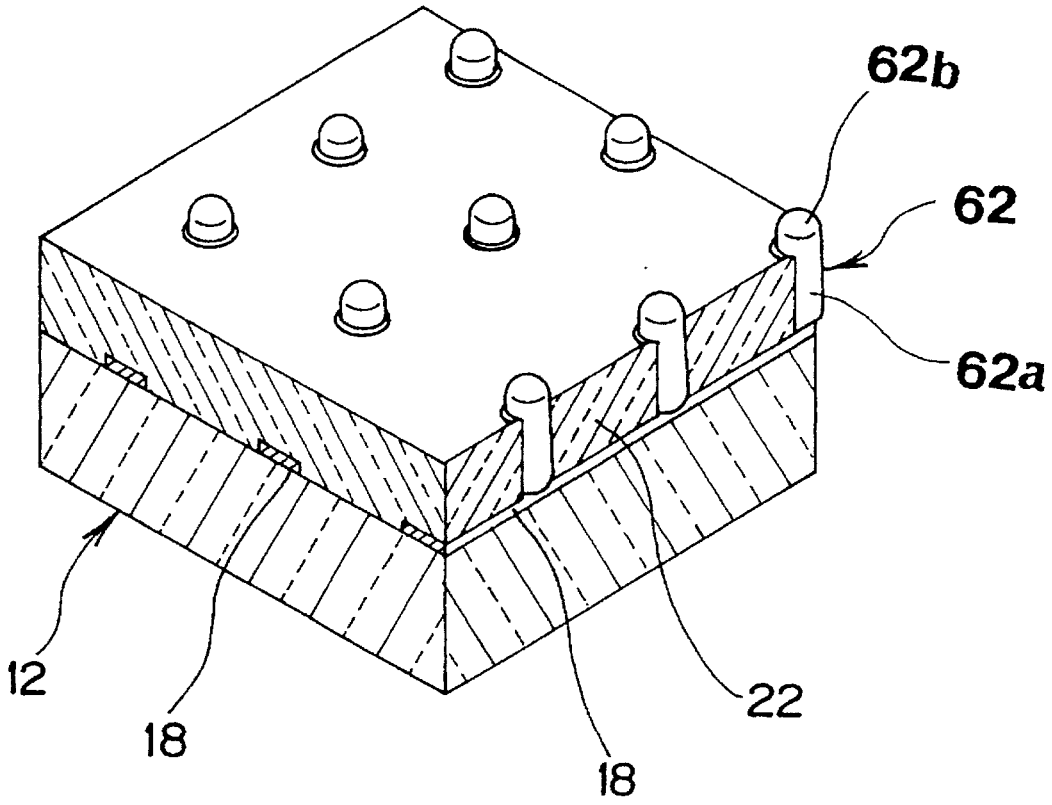
FIG. 14 is a partial perspective view for showing a rear substrate of FIG. 13.
Figure 15:
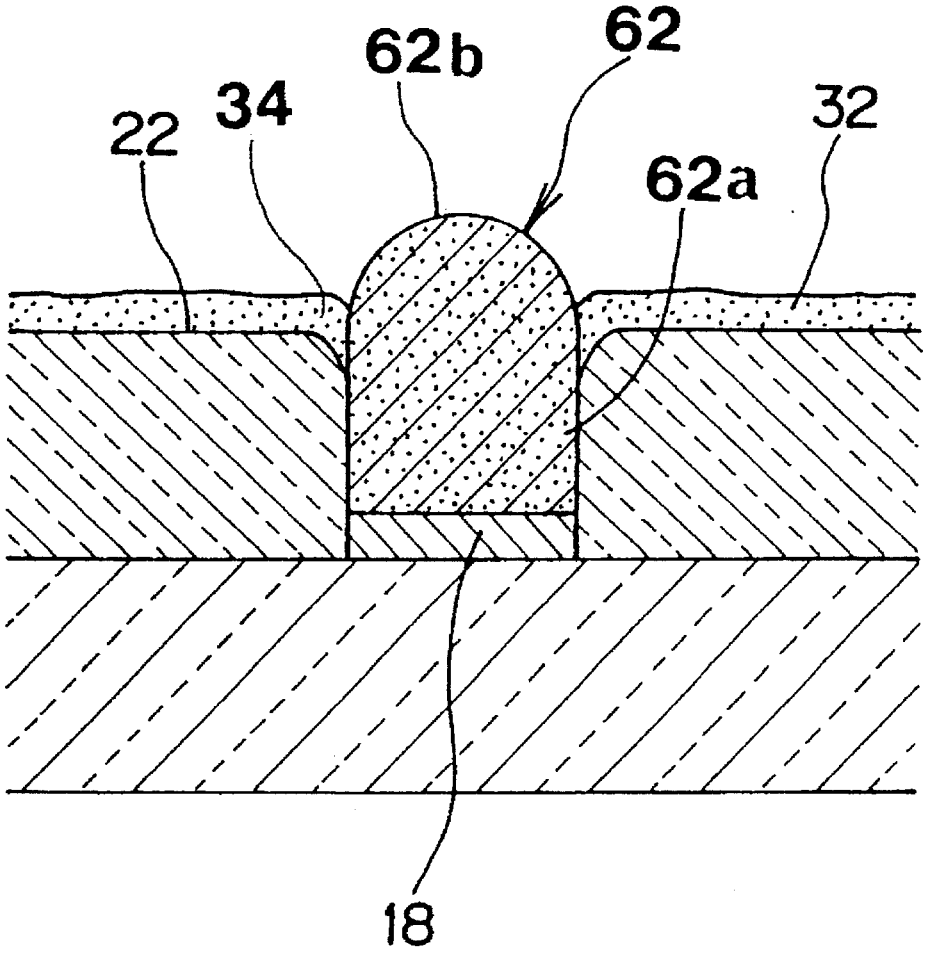
FIG. 15 is an enlarged partial cross-section for showing a second cylindrical cathode of FIG. 13.

Referring to FIGS. 13 to 15, differences between a third gas-discharging type display device 60 and first gas-discharging type display device 10 are described below.

Third gas-discharging type display device 60 includes a second cylindrical cathode 62 in which one end 62*a* is the same shape as that of first cylindrical cathode 20. The other end 62*b* of second cylindrical cathode 62 protruding outside of cathode support layer 22 has a spherical shape. To produce the spherical shape, end 20*b* of first cylindrical cathode 20 undergoes a blast process to remove the edge and a buff-grinding process to smooth the edge. Second cylindrical cathode 62 is formed of an emitter material which contains $GdB_6$ and $BaAl_2O_4$ in a ratio of 2:1.

In second cylindrical cathode 62, not only end 62*b* but also the side can be involved in discharging, because of exposing the side. More discharging occurs entirely in discharge cell 30. More ultraviolet emission generated by the discharging activates fluophor 32 on the surface of cathode support layer 22. An increase of light emission from fluophor 32 increases the brightness of the display device. The spherical shape uniformly produces an electric field on the surface and prevents the electric field from partially concentrating on the surface of electrode, thereby maintaining stability during discharging. First cylindrical cathode 20 can be used instead of second cylindrical cathode 62.

Figure 16:
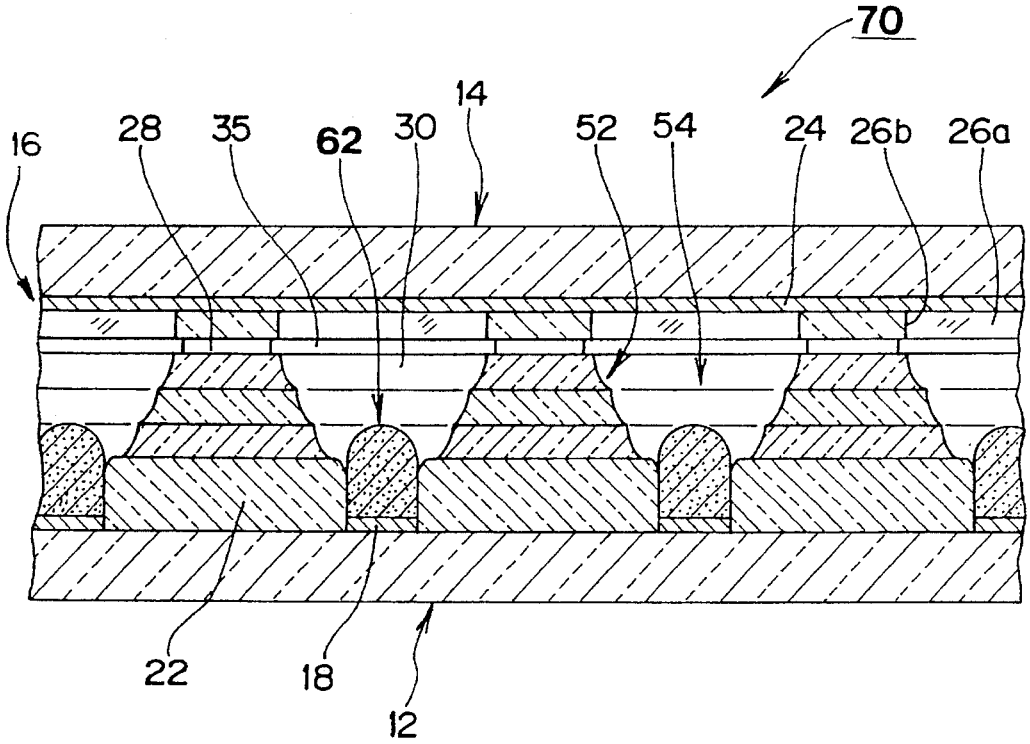
FIG. 16 is a cross-section of a fourth gas-discharging type display device of the invention.
Figure 17:
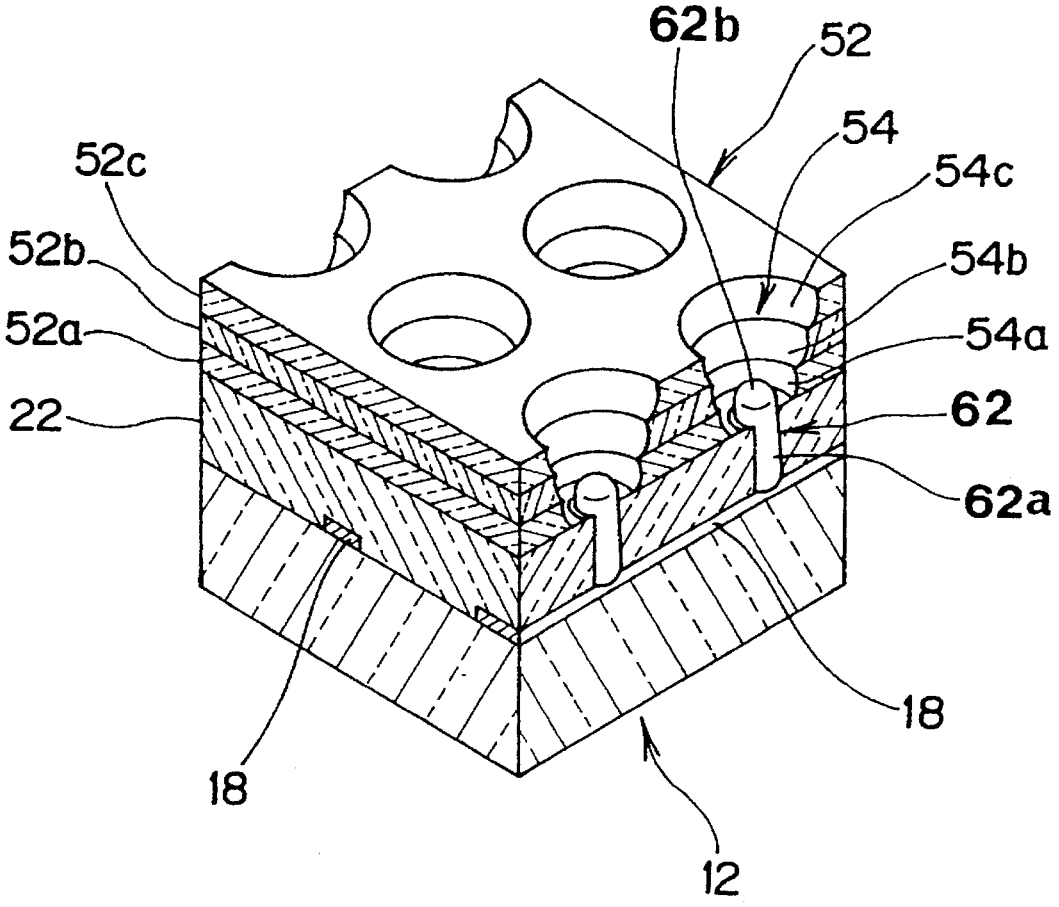
FIG. 17 is a partial perspective view for showing a rear substrate of FIG. 16.
Figure 18:
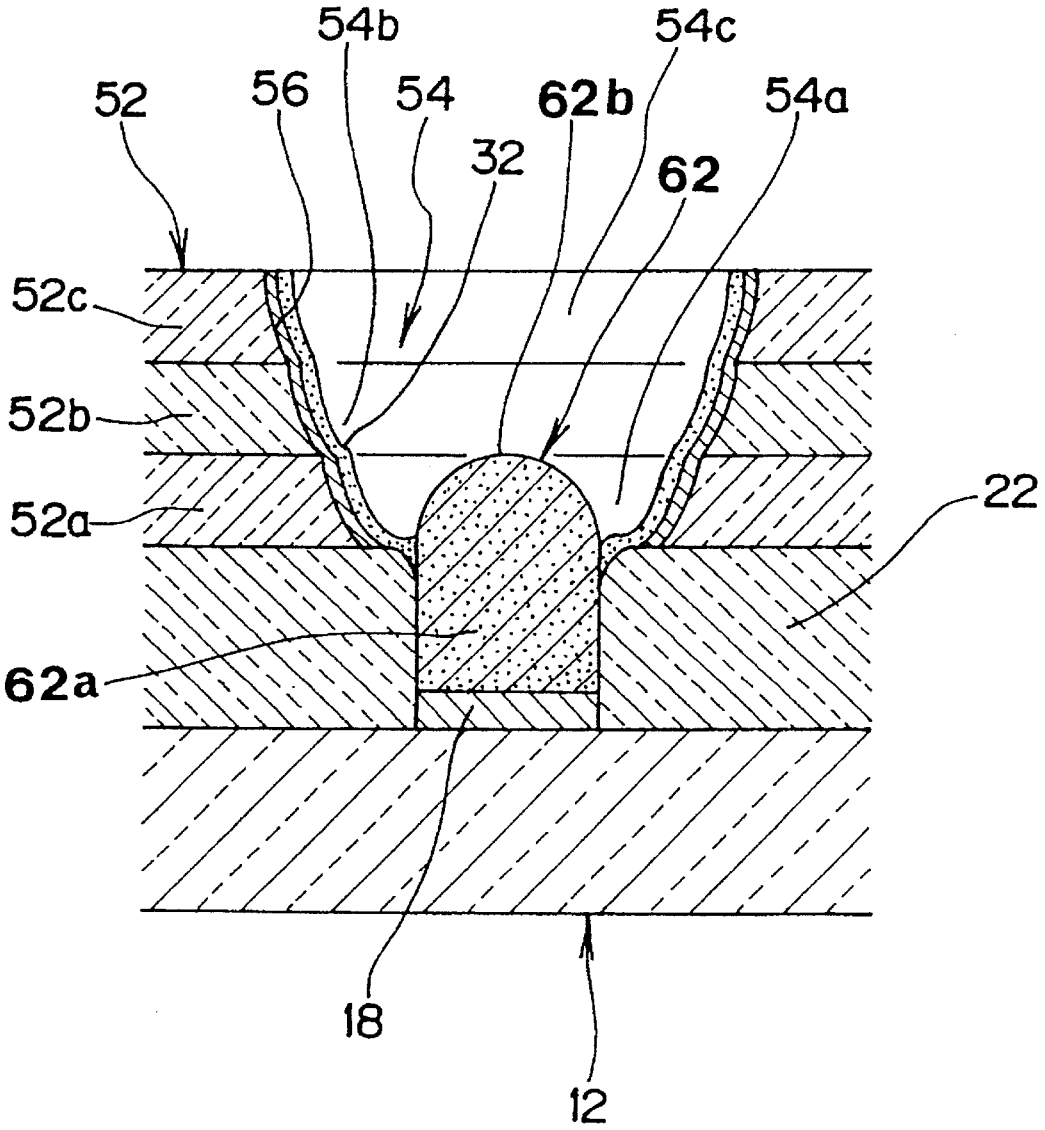
FIG. 18 is an enlarged partial cross-section for showing a second cylindrical cathode of FIG. 16.

Referring to FIGS. 16 to 18, a fourth gas-discharging type display device 70 is based on second gas-discharging type display device 50. Instead of first cylindrical cathode 20, a second cylindrical cathode 62 is utilized. Fourth gas-discharging type display device has the following feature:

1. Second cylindrical cathode 62 protrudes outside of cathode support layer 22. Therefore, discharging occurs at a wider area of second cylindrical cathode 62 in discharge cell 30. An increase of light emission raises the brightness.

2. Opening 54 of rear barrier rib 52 has a shape in which each of the openings in each layer is concentric with the corresponding opening in the other layer, and the diameter of each of the concentric openings is progressively larger than the opening below it. Further, light reflecting layer 56 is applied to the inner wall of each opening 54 to reflect the light by discharging and then to effectively gather it at front substrate 14.

3. End **62*b* of second cylindrical cathode 62** has a spherical shape. Then, an electric field is uniformly distributed throughout the surface of the electrode, resulting in stability during discharging.

In first to fourth gas-discharging type display devices 10, 50, 60 and 70, a gas containing Xe as an ultraviolet emission gas is put into airtight chamber 16. First and second cylindrical cathodes 20 and 62 are formed of emitter material 40 of $GdB_6$ and $BaAl_2O_4$. In contrast, prior-art gas-discharging type display device 90 has an emitter material containing $LaB_6$ as a main ingredient which absorbs Xe gas. An ultraviolet emission is obstructed by the absorption. Using $GdB_6$ for emitter material solves this problem because $GdB_6$ is incapable of absorbing Xe. Since $GdB_6$ has some common chemical properties as $LAB_6$, a required property for an emitter material such as a low starting voltage for discharging and an anti-spatter property are maintained. $BaAl_2O_4$ significantly lowers the starting voltage for discharging, but it has less electric conductivity. Therefore, $GdB_6$ and $BaAl_2O_4$ are preferably mixed for emitter material 40.

First cylindrical cathode 20 and second cylindrical cathode 62 can be formed by MoB instead of $GdB_6$. For example, MoB and $BaAl_2O_4$ are mixed in a ratio of 2:1 as an emitter material. MoB also has no property to absorb Xe. Since MoB has some common chemical properties as $LaB_6$ and $GdB_6$, the required emitter property can be maintained.

Since Kr can exist with $LAB_6$, Kr can be utilized instead of Xe for first cylindrical cathode 20 and second cylindrical cathode 62.

In the embodiment, the panel-shaped gas-discharging type display device with a cylindrical cathode is disclosed. However, the application is not limited to the above embodiment. For example, the combination of an ultraviolet emission gas and an emitter material to prevent an ultraviolet emission gas from being absorbed by an emitter material can be applied to another ultraviolet-emission gas-discharging type display device.

Figure 19:
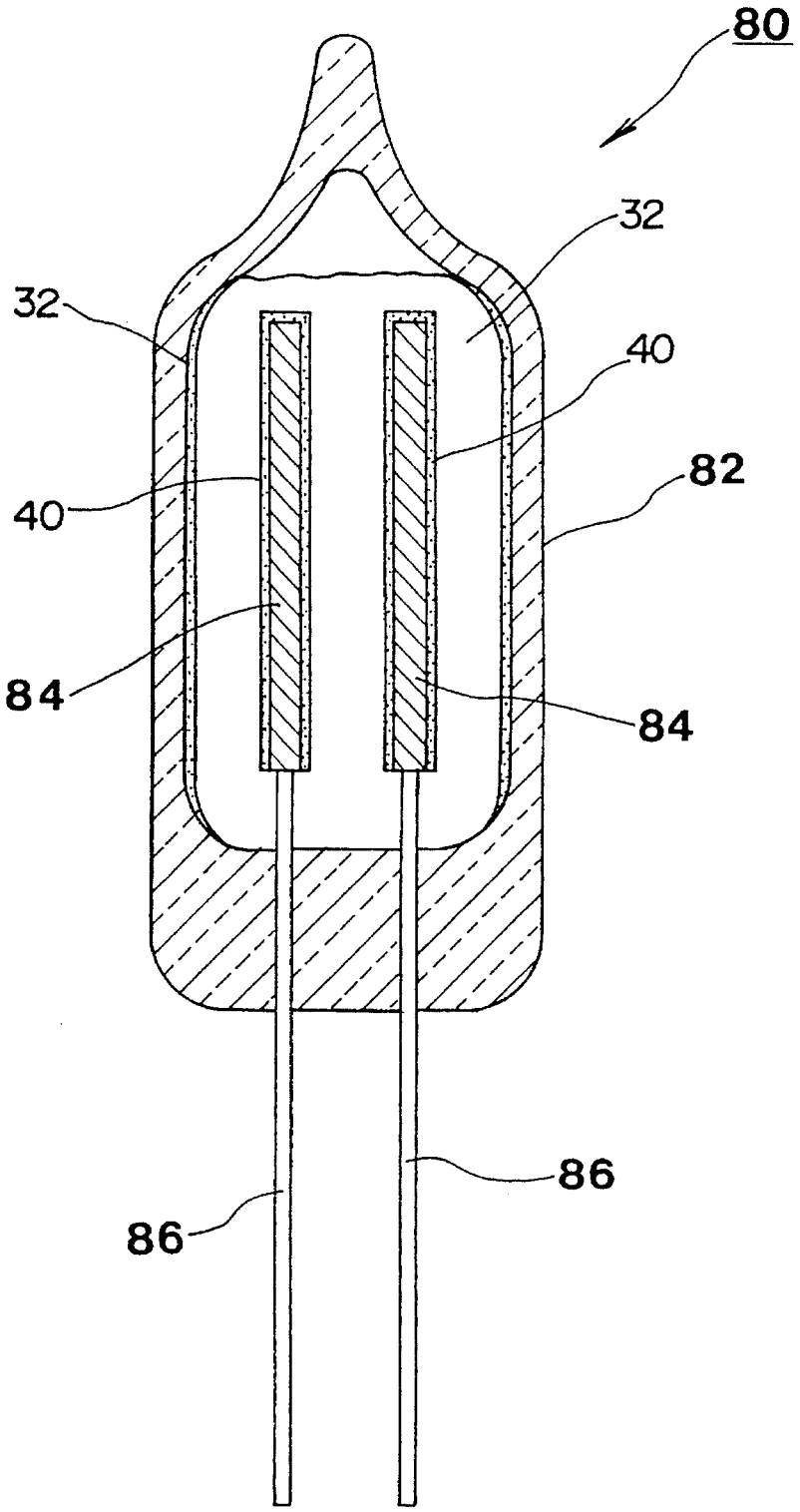
FIG. 19 is a cross-section of a fifth gas-discharging type display device of the invention.
Figure 20:
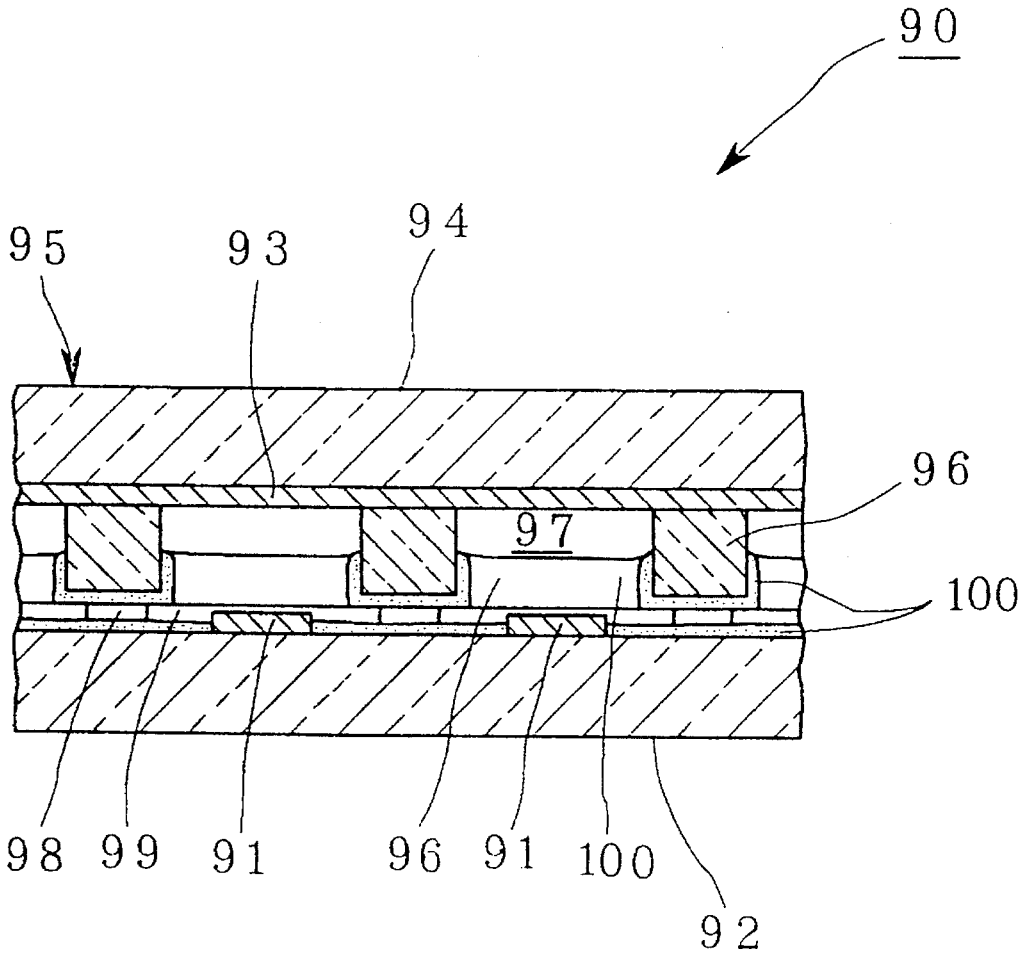
Fig. 20 PRIOR ART
FIG. 20 is a cross-section of the prior art.

Referring to FIG. 19, there is shown another application of this invention. A fifth gas-discharging type display device 80 includes a cylindrical glass pipe. An airtight chamber 82 is produced by melting both ends of the cylindrical glass pipe. A pair of pole-like discharging electrodes 84 and an ultraviolet emission gas are put together in airtight chamber 82. Fluophor 32 is applied to the inner wall of airtight chamber 82. A pair of lead terminals 86 connected to pole-like discharging electrodes 84 are led to the outside of airtight chamber 82. Emitter material 40 is applied on the surface of pole-like discharging electrodes 84. Xe is used for an ultraviolet emission gas. $GdB_6$ or MoB is used for emitter material 40 to prevent absorbing of the ultraviolet emission gas. It is acceptable to take Kr for the ultraviolet emission gas or $LaB_6$ for emitter material 40.

As described above, the gas-discharging type display device in the invention provides a visible radiation of a desired color simply by means of a fluophor excited by ultraviolet-emission. However, the technique of varying the shape of electrodes to enhance discharging can be applied to the gas-discharging type display device in which a visible radiation is directly obtained by discharging and is utilized as a light source.

Having described preferred embodiments of the invention with reference to the accompanying figures, it is to be understood that the invention is not limited to those precise embodiments, and that various changes and modifications may be effected therein by one skilled in the art without departing from the scope or spirit of the invention as defined in the appended claims.

What is claimed is:

1. A gas-discharging type display device comprising:

a front substrate formed of a transparent insulating material;

at least one anode on said front substrate, said at least one anode being formed of a transparent conductive material;

a rear substrate formed of an insulating material;

at least one cathode formed of an emitter material on said rear substrate;

at least one junction where said at least one anode and said at least one cathode are in adjacent spaced relation to each other a predetermined distance apart, making at least one discharge cell at said at least one junction;

said front substrate and said rear substrate forming an airtight chamber;

said airtight chamber filled with a discharge gas;

a cathode lead pattern on an inner surface of said rear substrate;

a cathode support layer covering said cathode lead pattern;

said cathode support layer having at least one hole therein; and said at least one cathode having a cylindrical shape, having a end connected to said cathode lead pattern at said at least one hole in said cathode support layer and a second end protruding from said cathode support layer into said at least one discharge cell.

2. A gas-discharging type display device according to claim 1 further comprising:

a barrier rib on said cathode support layer;

said barrier rib having a plurality of spaces corresponding to said at least one discharge cell; and said spaces having an inverted frusto-conical shape extending from said cathode support layer to said front substrate.

3. A gas-discharging type display device according to claim 2 further comprising:

a light reflecting layer formed on an inner surface of said at least one discharge cell.

4. A gas-discharging type display device according to claim 1, wherein:

said second end of said at least one cathode has a spherical shape; and said second end is exposed in said airtight chamber to said discharge gas.

5. A gas-discharging type display device according to claim 2, wherein:

said second end of said at least one cathode has a spherical shape; and said second end is exposed in said airtight chamber to said discharge gas.

6. A gas-discharging type display device according to claim 3, wherein.

said second end of said at least one cathode has a spherical shape; and said second end is exposed in said airtight chamber to said discharge gas.

7. A gas-discharging type display device according to claim 1, wherein said discharge gas in said airtight chamber includes an ultraviolet emission gas.

8. A gas-discharging type display device according to claim 2, wherein said discharge gas in said airtight chamber includes an ultraviolet emission gas.

9. A gas-discharging type display device according to claim 3, wherein said discharge gas in said airtight chamber includes an ultraviolet emission gas.

10. A gas-discharging type display device according to claim 4, wherein said discharge gas in said airtight chamber includes an ultraviolet emission gas.

11. A gas-discharging type display device according to claim 7, wherein:

said ultraviolet emission gas contains at least Xe; and said emitter material contains at least $GdB_6$.

12. A gas-discharging type display device according to claim 8, wherein:

said ultraviolet emission gas contains at least Xe; and said emitter material contains at least $GdB_6$.

13. A gas-discharging type display device according to claim 9, wherein:

said ultraviolet emission gas contains at least Xe; and said emitter material contains at least $GdB_6$.

14. A gas-discharging type display device according to claim 10, wherein:

said ultraviolet emission gas contains at least Xe; and said emitter material contains at least $GdB_6$.

15. A gas-discharging type display device according to claim 7, wherein:

said ultraviolet emission gas contains at least Xe; and said emitter material contains at least MoB.

16. A gas-discharging type display device according to claim 8, wherein:

said ultraviolet emission gas contains at least Xe; and said emitter material contains at least MoB.

17. A gas-discharging type display device according to claim 9, wherein:

said ultraviolet emission gas contains at least Xe; and said emitter material contains at least MoB.

18. A gas-discharging type display device according to claim 10, wherein:

said ultraviolet emission gas contains at least Xe; and said emitter material contains at least MoB.

19. A gas-discharging type display device according to claim 7, wherein:

said ultraviolet emission gas contains at least Kr; and said emitter material contains at least $LaB_6$.

20. A gas-discharging type display device according to claim 8, wherein:

said ultraviolet emission gas contains at least Kr; and said emitter material contains at least $LaB_6$.

21. A gas-discharging type display device according to claim 9, wherein:

said ultraviolet emission gas contains at least Kr; and said emitter material contains at least $LaB_6$.

22. A gas-discharging type display device according to claim 10, wherein:

said ultraviolet emission gas contains at least Kr; and said emitter material contains at least $LaB_6$.

23. A gas-discharging type display device according to claim 11, wherein:

said emitter material is a mixture of $GdB_6$ and $BaAl_2O_4$.

24. A gas-discharging type display device according to claim 12, wherein:

said emitter material is a mixture of $GdB_6$ and $BaAl_2O_4$.

25. A gas-discharging type display device according to claim 13, wherein:

said emitter material is a mixture of $GdB_6$ and $BaAl_2O_4$.

26. A gas-discharging type display device according to claim 14, wherein:

said emitter material is a mixture of $GdB_6$ and $BaAl_2O_4$.

27. A gas-discharging type display device according to claim 15, wherein:

said emitter material is a mixture of MoB and $BaAl_2O_4$.

28. A gas-discharging type display device according to claim 16, wherein:

said emitter material is a mixture of MoB and $BaAl_2O_4$.

29. A gas-discharging type display device according to claim 17, wherein:

said emitter material is a mixture of MoB and $BaAl_2O_4$.

30. A gas-discharging type display device according to claim 18, wherein:

said emitter material is a mixture of MoB and $BaAl_2O_4$.

31. A gas-discharging type display device according to claim 19, wherein:

said emitter material is a mixture of $LaB_6$ and $BaAl_2O_4$.

32. A gas-discharging type display device according to claim 10, wherein: said emitter material is a mixture of $LaB_6$ and $BaAl_2O_4$.

33. A gas-discharging type display device according to claim 21, wherein:

said emitter material is a mixture of $LaB_6$ and $BaAl_2O_4$.

34. A gas-discharging type display device according to claim 22, wherein:

said emitter material is a mixture of $LaB_6$ and $BaAl_2O_4$.

* * * * *